US008196522B2

(12) United States Patent
Bieker et al.

(10) Patent No.: US 8,196,522 B2
(45) Date of Patent: Jun. 12, 2012

(54) CHASSIS FRAME OF A RAIL VEHICLE

(75) Inventors: Guido Bieker, Kirchhundem (DE); Reinhard Pieper, Kirchhundem (DE)

(73) Assignee: Bombardier Transportation GmbH, Berlin (DE)

( * ) Notice: Subject to any disclaimer, the term of this patent is extended or adjusted under 35 U.S.C. 154(b) by 407 days.

(21) Appl. No.: 12/305,502

(22) PCT Filed: Jun. 19, 2007

(86) PCT No.: PCT/EP2007/056077

§ 371 (c)(1),
(2), (4) Date: Jul. 7, 2009

(87) PCT Pub. No.: WO2008/000657

PCT Pub. Date: Jan. 3, 2008

(65) Prior Publication Data

US 2010/0011985 A1 Jan. 21, 2010

(30) Foreign Application Priority Data

Jun. 27, 2006 (DE) ..... 10 2006 029 835

(51) Int. Cl.
*B61F 3/00* (2006.01)
*B61D 25/00* (2006.01)

(52) U.S. Cl. ..... 105/182.1; 105/414

(58) Field of Classification Search ..... 105/157.1, 105/158.1, 159, 182.1, 226, 228, 413–419
See application file for complete search history.

(56) References Cited

U.S. PATENT DOCUMENTS

| | | | | |
|---|---|---|---|---|
| 3,313,245 | A * | 4/1967 | Sundby | 105/198.7 |
| 3,840,096 | A * | 10/1974 | Tolksdorf | 188/165 |
| 4,436,142 | A * | 3/1984 | Mather | 164/337 |
| 4,765,250 | A * | 8/1988 | Goding | 105/166 |
| 6,346,132 | B1 * | 2/2002 | Huber et al. | 75/229 |
| 6,622,776 | B2 | 9/2003 | Bauer et al. | |
| 6,796,448 | B1 * | 9/2004 | Wilt et al. | 213/40 R |

FOREIGN PATENT DOCUMENTS

| | | | |
|---|---|---|---|
| DE | 4309004 | A1 | 9/1994 |
| EP | 0345708 | A1 | 12/1989 |
| EP | 0564423 | A1 | 10/1993 |
| GB | 1209389 | A | 10/1970 |

* cited by examiner

*Primary Examiner* — S. Joseph Morano
*Assistant Examiner* — R. J. McCarry, Jr.
(74) *Attorney, Agent, or Firm* — The Webb Law Firm

(57) ABSTRACT

A running gear frame for a running gear of a rail vehicle with a frame body, which is configured to be supported at least on one wheel unit of the running gear. The frame body has two longitudinal beams extending in a longitudinal direction of the running gear and at least one transverse beam extending in a transverse direction of the running gear. The transverse beam substantially rigidly connects the two longitudinal beams to each other. The frame body is at least partially made of grey cast iron material.

33 Claims, 5 Drawing Sheets

CHASSIS FRAME OF A RAIL VEHICLE

BACKGROUND OF THE INVENTION

1. Field of the Invention

The present invention relates to a running gear frame for a running gear of a rail vehicle with a frame body, which is configured to be supported on at least one wheel unit of the running gear. The invention furthermore relates to a running gear with a running gear frame according to the invention and to a respective method for producing a running gear frame.

2. Description of the Related Art

The production of structural components for rail vehicles, e.g. of frames or bogie bolsters for running gears, in particular of running gears, is performed today mostly by welding sheet material, as it is known, for example, from EP 0 345 708 A1 and EP 0 564 423 A1 This production method, however, has the disadvantage that it requires a relatively large percentage of manual labor, which makes the production of running gear frames comparatively expensive.

The percentage of cost intensive manual labor can be reduced in principle, when cast components are used instead of welded construction. Thus, it is known e.g. from GB 1 209 389 A or from U.S. Pat. No. 6,622,776 B2 to use cast steel components for a vehicle frame of a rail vehicle. While a one piece cast bogie frame is produced according to GB 1 209 389 A, according to U.S. Pat. No. 6,622,776 B2 the longitudinal beams and transverse beams of a bogie are made of one or plural standard cast steel components and are subsequently joined to form a bogie frame.

Cast steel has the advantage that it is weldable, so that this conventional joining method can also be used in this production variant. The cast steel, however, has the disadvantage that it has a rather limited flow capability. In conjunction with automated production of relatively large components with complex geometries, like e.g. running gear frames for rail vehicles, this leads to reduced process reliability, which is not acceptable in view of the high safety requirements which are placed upon a running gear of a rail vehicle. Therefore, also when producing such running gear frames from cast steel material, relatively many process steps still have to be performed manually and therefore no economically satisfactory degree of automation can be achieved with this process either, provided that the automation works at all.

Furthermore, it is known, for example from DE 43 09 004 A1, to produce relatively small load-bearing parts of the running gear suspension of multi-axle utility vehicles from grey cast iron.

Thus, it is the object of the present invention to provide a running gear frame as described above, which does not show the disadvantages described above, or at least shows them to a lesser extent, and which in particular facilitates simple production and thus an increased degree of automation of the production.

SUMMARY OF THE INVENTION

The present invention achieves this object based on a running gear frame according to the preamble of claim 1 through the features stated in the characterizing portion of claim 1. The invention furthermore achieves the object based on a method according to the preamble of claim 29 through the features stated in the characterizing portion of claim 29.

The present invention is based on the technical teaching that simple producibility and thus an increased degree of automation can be accomplished in the manufacture of a running gear frame for a rail vehicle, when the frame body is at least partially made of a grey cast iron material. The grey cast iron, thus, has the advantage that it comprises a particularly good flow capability during casting due to its high carbon content and thus leads to a very high level of process reliability. It has become apparent that also the production of comparatively large and complex components for the running gear frame can be performed in automated flasks, which makes the production of said components significantly simpler and more cost effective.

Grey cast iron material is not suitable for welding, since the carbon content in the material is too high. However, due to the good flow capability of the grey cast iron material during casting, very complex component geometries can be produced in a reliable manner, which otherwise would have to be produced through complex welded construction. Thus, a plurality of joining processes can be omitted. Furthermore, an optimized geometry of the joints, which may still be required, can be achieved for the same reason, so that, with a corresponding design of the components, also other joining methods can be used without problems.

Another advantage of the grey cast iron material is its improved damping property compared to the steel material which is typically used. This is particularly advantageous with respect to reducing the transmission of vibrations into the passenger compartment of a rail vehicle.

The grey cast iron material can be any suitable grey cast iron material. Preferably, it is a globular grey cast iron material (so called sphaeroidical cast iron material), in particular GGG40, which provides a good compromise between strength and elongation at fracture and toughness. Preferably, e.g. GGG40.3 or GJS-400-18U LT is used, which is characterized by advantageous toughness at low temperatures.

The frame body can be comprised of a single cast piece. Due to the typical size of such frame bodies, however, it can be advantageous to divide the frame body in order to achieve a high level of process reliability. Therefore the frame body comprises at least two frame components which are connected to each other in the area of at least one joint. Preferably the frame components are disengageably connected to each other in order to facilitate a subsequent maintenance or repair of the running gear.

It can be provided that all frame components are made of a corresponding grey cast iron material. However it can also be provided that particular frame components are not made of grey cast iron material. Thus, it can e.g. be provided that portions of the frame body, e.g. one or more transverse beams of the frame body are configured in a conventional manner as welded construction and/or as cast construction made of cast steel material.

The term frame component, in the sense of the invention, is to be understood as a structural component of the frame body substantially determining the general geometry of the frame body. In particular, these shall not be connection elements by means of which such frame components can be connected.

As a matter of principle, the frame components can be directly joined to each other through a suitable joining method. Preferably, at least one connection element is provided in the region of the joint and is connected to both frame components. The connection element may be integrally formed with one of the two frame components. Thus, it can be e.g. a protrusion, like a pinion or similar, which is formed during casting or formed subsequently and which may subsequently provided with the respective fitting surfaces.

Additionally or alternatively it can be provided that the connection element is connected with at least one of the two frame components through a friction locked connection and/or a form locked connection and/or a material bonded connection. Thus, the connection element can e.g. be a pin or a bolt, which is connected to the respective frame component through a press fit (primary friction lock in the joining direction), or an adhesive connection (primary material bond in the joining direction). Form locking can also be achieved through respective protrusions and undercuts at the connection element and at the frame component, respectively.

Preferably, the joint extends at least section wise substantially in a joining plane and the connection element forms at least one protrusion, which extends in the direction of the normal of the joining plane at least into one respective recess in one of the two frame components. Hereby a plug in joint can be accomplished, which can be joined in a simple manner, in which at least one of the above described form—or friction locked or bonded connections can be used in joining direction, while a form locked connection transverse to the joining direction is accomplished via the protrusion, which depending on the contact conditions, in particular depending on the contact force between the frame components, may still be supplemented or supported at the joining location by friction locking.

The connection element, as a matter of principle, can be configured in any suitable manner. Preferably it is configured as a pin or bolt as already described above. The connection element, in principle, can furthermore have any suitable cross section or cross section profile. Thus, it can e.g. have a substantially constant cross section over its length, thus, it can be provided as a simple cylinder bolt or as a cylindrical pin, since such a shape can be produced in a particularly simple manner.

It is also possible that the connection element, at least section wise, has a cross section which tapers with increasing distance from the joining plane. Due to the self centering of the joining partners which can be achieved hereby, the joining process is simplified, so that it can be automated in a simple manner under certain conditions.

The cross section of the connection element can, as a matter of principle, also be configured in any suitable manner. Preferably, the connection element, at least section wise, has a circular cross section and/or, at least section wise, has an elliptical cross section and/or, at least section wise, has a polygonal cross section.

A cross sectional shape deviating from a circular shape certainly has the advantage of a reliable additional rotation safety and of a self adjustment about the joining axis, which facilitates automated joining. Such connection elements with a cross section deviating from a circular shape are more complex to produce. However this only applies when a respectively complex finishing of the joining surfaces is required. Due to the grey cast iron material used according to the invention and due to its good flow properties, the joining surfaces however can also be produced through an automated casting process with sufficient precision, so that such a complex finishing of the joining surfaces may also be omitted.

In preferred variants of the running gear frame according to the invention it is provided that the connection element is disposed in the portion of a section of the frame body which is under a tensile static stress and/or disposed, so that it is under a shear stress due to the static load of the frame body. The disposition in a section of the frame body which is under a tensile stress under static loading has the advantage that the support of moments in the portion under static compression load can be simply performed through the two frame components to be connected. Furthermore, this has the advantage that, due to the high weight of a rail vehicle, typically, for a large portion of the dynamic loads to be expected during driving operation, a certain compression load always exists in the portion which is under a compression load during static loading, such that, eventually, a permanent pre loading between the frame components to be connected can be assumed. Thus, the connection may even be configured without additional connection elements, or only using a simple lift off safety in the portion which is compression loaded under static loading.

The primarily occurring shear load ultimately yields the advantage that the connection element, e.g. a pin or bolt, during operation is primarily loaded in a direction transverse to its joining or assembly direction. The strength of the connection between the two frame components to be joined thus becomes at least largely independent from the quality of the joining process (for example, no particular tightening torques need to be maintained), but it only depends on the properties (e.g. the shear strength etc.) of the connection element. Thus, possibly, a simple position safety of the connection element (e.g. through safety rings, press fit of the connection components etc.) is sufficient to assure a durable and reliable connection of the frame components.

In variants of the running gear frame according to the invention which can be manufactured in a particularly simple manner, at least one connection element is configured as an element which bridges the joint and which is connected to both joining partners. Thus, it can be configured in particular as a tension anchor operating in the direction of the surface normal of the joining plane, or as a plate bridging the joining location.

In order to facilitate simple testing of the quality of the connection between the frame components, in advantageous variants of the running gear frame according to the invention, it is provided that the connection element comprises at least one recess for receiving a component of a non destructive material testing device, in particular of a material testing device operating with ultra sound. This component can be a permanently integrated device, which is addressed from time to time. This component can furthermore be a respective sensor and/or a respective actuator, which generates a respective excitation of the joining partners.

In additional preferred variants of the running gear frame according to the invention it is provided that at least one of the components interacting in the portion of the joint is at least partially provided with a coating preventing friction corrosion, in particular with a coating comprising molybdenum (Mo), in order to guarantee a permanently reliable connection.

As a matter of principle, the running gear frame may be of any design. Thus, it can e.g. be a running gear frame for a single running gear with only one wheel unit (e.g. a wheel set or a wheel pair). In a particularly advantageous manner, it can also be used in larger and thus more complex running gears with multiple wheel units (e.g. wheel sets or wheel pairs). The frame body therefore preferably comprises a forward section, a center section, and a rear section, wherein the center section connects the forward section and the rear section, the forward section is configured to be supported on a leading wheel unit of the running gear and the rear section is configured to be supported on a trailing wheel unit of the running gear.

In frame bodies with multiple components the joints between the frame components as a matter of principle can be disposed at any location and thus can be advantageously tailored to the available automated casting method. In advantageous variants of the running gear frame according to the invention it is provided that the frame body comprises at least two frame components which are connected to one another in the region of at least one joint, in particular disengageably connected. At least one joint is disposed in the center section and/or at least one joint is disposed in the region of the forward section and/or at least one joint is disposed in the region of the rear section.

For example, when a transverse beam is disposed in the center section, the joint can also extend in the region of the center section Then the frame body can be assembled from two identical cast component halves, which of course significantly simplifies fabrication.

In principle the running gear frame can be of any design. In a particularly advantageous manner the present invention can be used, however, in conjunction with running gear frames in which the frame body is configured as a frame, which comprises two longitudinal beams extending in the longitudinal direction of the running gear and at least one transverse beam extending in the transverse direction of the running gear and connecting the two longitudinal beams to each other. In particular, the frame body can be configured as a substantially H shaped frame.

A high level of automation of the production with high process reliability can be achieved when the frame body is divided into as few different frame components as possible in which the flow of the molten material in the mold is obstructed by deflections or other obstacles as little as possible. It is thus preferably provided that at least one of the longitudinal beams comprises at least one longitudinal beam section, which is connected, in particular disengageably connected, in the region of at least one joint with the at least one transverse beam or with another longitudinal beam section of the longitudinal beam.

In advantageous variants of the running gear frame according to the invention, the longitudinal beam is designed in one piece and connected with the at least one transverse beam in the portion of the joint. The joining direction can thus extend in the direction of the transverse axis of the running gear, so that a contact or joining plane between the longitudinal beam and the transverse beam is created, whose surface normal comprises at least one component in the direction of the transverse axis of the running gear. In other words, the longitudinal beam can be laterally attached to the transverse beam, this means in the direction of the transverse axis of the running gear.

It is preferably provided that the joint—additionally or alternatively—at least section wise substantially extends in a joining plane the surface normal of which comprises at least one component in the direction of the height axis of the running gear, in particular extends substantially parallel to the height axis of the running gear. Thus, the transverse beam can then e.g. be simply placed onto the longitudinal beam from the top. The transverse beam, thus only has to be secured against a liftoff from the longitudinal beam, which typically only occurs under extreme operating conditions, or during maintenance due to the typically high weight of the vehicle components supported on the transverse beam.

In other advantageous variants of the running gear frame according to the invention, the longitudinal beam comprises two longitudinal beam sections, which are connected to the at least one transverse beam in the region of one respective joint. Hereby, the comparatively long longitudinal beam is divided into two shorter longitudinal beam sections, which can be produced in an automated manner more simply. Preferably, it is provided also here that at least one of the joints at least section wise extends substantially in one joining plane the surface normal of which comprises at least one component in the direction of the height axis of the running gear, and which, in particular, is substantially parallel to the height axis of the running gear. In other words, the transverse beam can be placed in turn onto the two longitudinal beam sections from the top. Additionally or alternatively, at least one of the joints at least section wise can substantially extend in one joining plane the surface normal of which comprises at least one component in the direction of the transverse axis of the running gear, and is in particular substantially parallel to the transverse axis of the running gear. In other words, the two longitudinal beam sections can be laterally applied to the transverse beam, this means in the direction of the transverse axis of the running gear.

In other advantageous variants of the running gear frame according to the invention, at least one of the longitudinal beams comprises a forward longitudinal beam section, a 1s center longitudinal beam section and a rear longitudinal beam section, wherein the center longitudinal beam section is connected to the at least one transverse beam. Preferably, the center longitudinal beam section is then monolithically formed with the at least one transverse beam, so that the center beam section can be integrated into the transverse beam without significantly increasing its complexity and thus jeopardizing its automated producibility. Then, eventually, only the comparatively short forward and rear longitudinal beam section, respectively, has to be cast separately, which can be simply produced in an automated manner, and which is then connected to the center longitudinal beam section in the region of the joint.

The connection between the forward or rear longitudinal beam section and the center longitudinal beam section can be performed in principle in any manner Preferably, at least one of the joints at least section wise extends substantially in a joining plane the surface normal of which comprises at least one component in the direction of the longitudinal axis of the running gear and, in particular, is substantially parallel to the longitudinal axis of the running gear. The forward or rear longitudinal beam section can then be simply attached to the center longitudinal beam section in the direction of the longitudinal axis of the running gear from the front or from the rear.

Additionally or alternatively, at least one of the joints at least section wise can extend substantially in one joining plane the surface normal of which comprises at least one component in the direction of the transverse axis of the running gear, and, in particular, is substantially parallel to the transverse axis of the running gear. In other words, the forward or rear longitudinal beam section can be laterally (i.e. in the direction of the transverse axis of the running gear) attached to the center longitudinal beam section.

Additionally or alternatively, at least one of the joints at least section wise can extend substantially in a joining plane the surface normal of which comprises at least one component in the direction of the height axis of the running gear, and, in particular, is substantially parallel to the height axis of the running gear. In other words, the forward or rear longitudinal beam section can be attached to the center longitudinal beam section from the top or, preferably, from the bottom (i.e. in the direction of the height axis of the running gear).

In additional advantageous variants of the running gear frame according to the invention it is provided that a compression element is disposed between the forward longitudinal beam section or the rear longitudinal beam section, respectively, and the center longitudinal beam section in the region of least one of the joints. Said compression element can on the one hand be used advantageously to compensate for fabrication tolerances between the joining partners in a simple manner. Eventually, it can also be configured to take over the function of the primary spring system of the running gear.

In further advantageous variants of the running gear frame according to the invention at least one of the longitudinal beams respectively comprises a downward pointing angulation between the longitudinal beam ends and the longitudinal beam center, and at least one of the joints is disposed in the region of the angulation or on the side of the angulation facing away from the center of the longitudinal beam, and, in particular, is disposed in proximity to the angulation. Hereby, it is possible to dispose the joint in a portion of a longitudinal beam in which on the one hand already a cross section of the component is provided, which is sufficiently large for a stable connection, and where on the other hand still comparatively small bending moments occur, so that the loads to be borne by the connection are still comparatively moderate. This provides that the complexity for the joint still remains within reasonable limits.

In further advantageous variants of the running gear according to the invention at least a portion of at least one of the longitudinal beams is produced from grey cast iron material. Preferably these are at least the longitudinal beam ends, thus the forward and rear longitudinal beam sections, which are made from grey cast iron material. The center longitudinal beam section and/or the transverse beam may also be made from grey cast iron material, or they may rather be configured in a conventional manner as a welded construction and/or as a cast construction made of cast steel.

The present invention furthermore relates to a running gear for a rail vehicle with a running gear frame according to the invention. Hereby, the variants and advantages described above can be realized to the same extent, so that the explanations given above are being referred to. The running gear according to the invention is preferably configured as a bogie.

The present invention furthermore relates to a method for producing a running gear frame for a rail vehicle with a frame body, which is configured to be supported on at least one wheel unit of the running gear. According to the invention it is provided that the frame body is produced from grey cast iron material. Thus, the variants and advantages described above can also be realized to the same extent, so that it is only referred to the descriptions given above in this respect.

In advantageous variants of the method according to the invention the frame body is cast in a single step. In other advantageous variants of the method according to the invention the frame body comprises at least two frame components. The at least two frame components are cast from grey cast iron material as separate components and are then connected, preferably disengageably connected, to each other in the region of at least one joint.

As described above, a portion of the frame body according to the invention can be made of grey cast iron material and a portion of the frame body can be made of steel. In other advantageous embodiments of the method according to the invention it is thus provided that the frame body comprises at least two frame components. At least one of the at least two frame components is then cast from grey cast iron material, while at least one of the at least two frame components is made from steel. The at least two frame components are then connected, in particular disengageably connected, to each other in the region of at least one joint.

BRIEF DESCRIPTION OF THE DRAWINGS

Additional preferred embodiments of the invention become apparent from the dependent claims or from the subsequent description of a preferred embodiment, which refers to the appended drawing figures, wherein:

DETAILED DESCRIPTION OF THE INVENTION

First Embodiment

Figure 1:
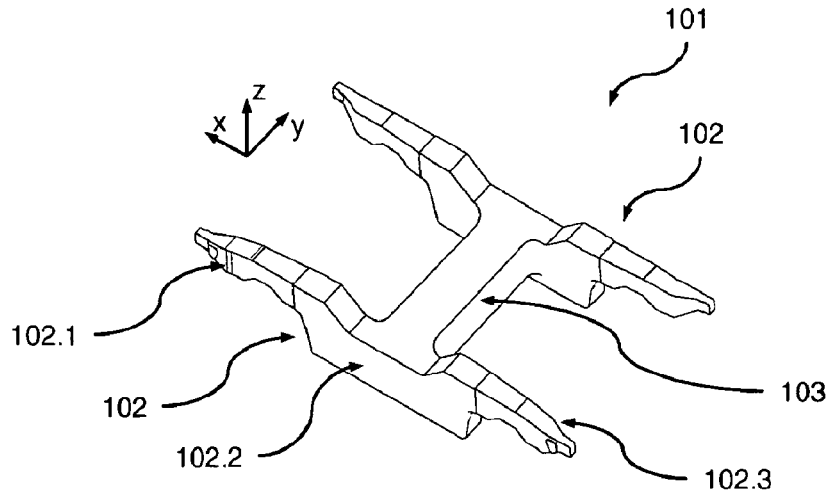
FIG. 1 shows a schematic perspective illustration of a preferred embodiment of the running gear frame according to the invention.

In the following, initially a first preferred embodiment of the running gear frame according to the invention configured as a bogie frame 101 is described with reference to FIG. 1. FIG. 1 illustrates a perspective view of the bogie frame 101, which comprises two substantially parallel lateral longitudinal beams 102, which are connected by a centrally disposed transverse beam 103.

Each longitudinal beam 102 comprises a forward longitudinal beam section 102.1, a center longitudinal beam section 102.2 and a rear longitudinal beam section 102.3. In the region of the forward longitudinal beam section 102.1 the later bogie is supported via a primary spring suspension—not shown—on a forward wheel unit, e.g. a forward wheel set—not shown either. In the region of the rear longitudinal beam section 102.3 the later bogie is supported via a primary suspension—not shown—on a rear wheel unit, e.g. a rear wheel set—not shown either.

The bogie frame 101 is produced as a one piece cast part through an automated casting process from a grey cast iron material. As a grey cast iron material GGG40.3 or GJS-400-18U LT is used, i.e. a high carbon content globular grey cast iron material, so called sphaeroidical cast iron material. This material has the advantage that its molten mass, due to its high carbon content, has a comparatively high flow capability, such that even with an automated casting method a process reliability can be accomplished which is high enough for the bogie frames 101 thus produced to comply, to a satisfactory extent under economic considerations, with the stringent safety requirements which are pertinent to a bogie frame 101 of a bogie of a rail vehicle,.

Second Embodiment

Figure 2:
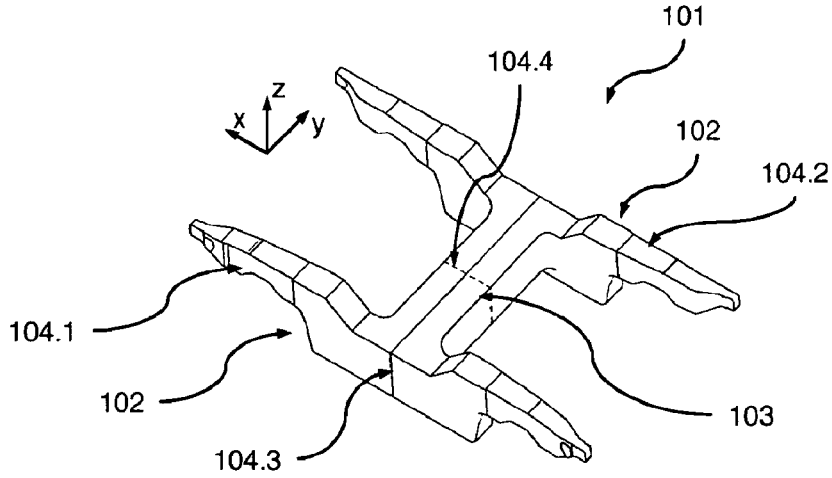
FIG. 2 shows a schematic perspective illustration of another preferred embodiment of the running gear frame according to the invention.

FIG. 2 shows a schematic perspective illustration of another preferred embodiment of the bogie frame according to the invention, which constitutes a simple variant of the bogie frame 101. The bogie frame 101 is here divided into two halves in the form of a forward section 104.1 and a rear section 104.2, which are connected to each other in the region of a joint 104.3.

The forward section 104.1 and the rear section 104.2 are configured as identical components from grey cast iron (GGG40.3 or GJS-400-18U LT), which significantly simplifies their production, since only a single basic shape has to be produced. However, it is appreciated that also a different geometry for each of the two halves can be provided in other variants of the invention.

The joint 104.3 extends through the center of the transverse beam 103. Thus, the joint extends substantially in a joining plane the normal of which extends parallel to the longitudinal axis (x-axis) of the bogie frame 101. This arrangement of the joining plane has the advantage that the longest dimension at the respective cast component is limited, which yields shorter maximum flow paths for the molten material, which simplifies automated casting and increases its process reliability, respectively.

However it is understood that a different arrangement of the joint of the two halves can be provided in other variants of the invention. Thus, it can substantially extend in the center of the transverse beam 103, so that the surface normal of its joining plane extends parallel to the transverse axis (y-axis) of the bogie frame 101 as indicated by the dashed contour 104.4 in FIG. 2. The bogie frame 101 thus comprises a left section 104.1 and a right section 104.2, which are preferably configured identical.

The connection between the forward/left section 104.1 and the rear/right section 104.2 can be provided in any suitable manner. Thus, any connection with friction locking, form locking or bonding, or any combination thereof can be selected according to the load situations to be expected at the bogie. For example, the forward/left section 104.1 and the rear/right section 104.2 can be clamped together through tension anchors as connection elements aligned in the direction of the longitudinal axis/transverse axis (x-axis/y-axis) of the bogie frame 101 and/or they can be connected through one or plural respective bolts or pins extending in said direction, which are e.g. pressed into suitable recesses or connected to the respective sections 104.1 and 104.2 in other manners.

Third Embodiment

Figure 3:
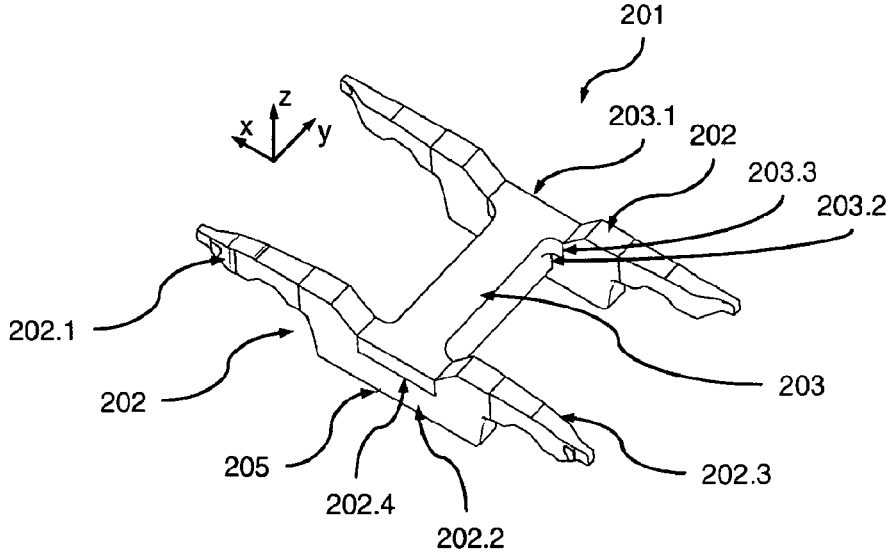
FIG. 3 shows a schematic perspective illustration of another preferred embodiment of the running gear frame according to the invention.

FIG. 3 shows a schematic perspective illustration of another preferred embodiment of the running gear frame 201 according to the invention, which has the same exterior geometry as the bogie frame 101. The bogie frame 201 is configured in three components, wherein the two substantially parallel longitudinal beams 202 and the connecting centrally disposed transverse beam 203 are configured as separate components from grey cast iron (GGG40.3 or GJS-400-18U LT).

The transverse beam 203 at its upper side is provided with one respective lateral protrusion 203.1 each. The respective protrusion 203.1 is inserted from the top, this means along the height axis (z-axis) of the bogie frame 201, into a respective recess 202.4 of the longitudinal beam 202. The respective longitudinal beam 202 contacts a lateral contact surface 203.2 of the transverse beam 203 in the direction of the transverse axis (y-axis) of the bogie frame 201, wherein said contact surface is provided below the protrusion 203.1. In the direction of the longitudinal axis (x-axis) the respective longitudinal beam 202 contacts a forward and a rear contact surface 203, respectively, of the protrusion 203.1 of the transverse beam 203.

Furthermore, the respective longitudinal beam 202 is connected to the transverse beam 203 through one or more connection elements 205, e.g. tension anchors, operating in the direction of the transverse axis (y-axis) of the bogie frame 201, said tension anchors preventing a liftoff or pull off of the transverse beam 203 along the height axis (z-axis) or along the transverse axis (y-axis), so that a solid connection is assured in all directions. It is appreciated, however, that the connection between the transverse beam 203 and the respective longitudinal beam 202 can also be performed in any other suitable manner. Thus, any connection with friction locking, form locking or bonding, or any suitable combination thereof can be selected according to the load situations to be expected at the bogie.

In other words, in the described configuration this yields respective joints with three joining planes the surface normals of which extend in the direction of all three major axes (x-, y-, z-axis) of the bogie frame 201. The main loads during operation (weight forces, braking and acceleration forces) are thus mostly supported directly at contact surfaces of the longitudinal beams 202 and the transverse beam 203, so that a favorable load transfer between the longitudinal beams 202 and the transverse beam 203 is accomplished.

The longitudinal beams 202 are configured as identical components made of grey cast iron (GGG40.3 or GJS-400-18U LT), which significantly simplifies their fabrication, since only one single basic shape needs to be manufactured. The division into separate longitudinal beams 202 and the transverse beam 203 simplifies automated casting and improves its process reliability, respectively, since the molten mass only has to flow along substantially straight flow paths without having to pass through significant deflections.

Fourth Embodiment

Figure 4:
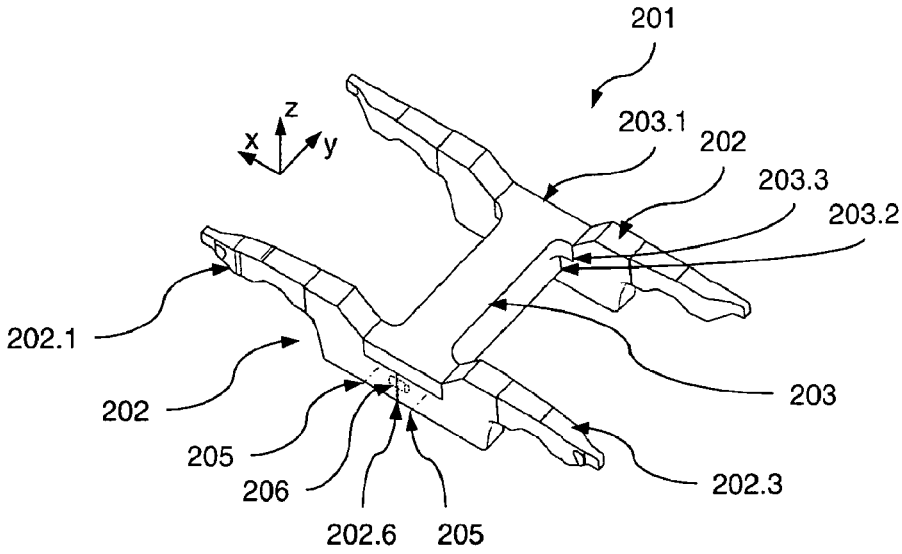
FIG. 4 shows a schematic perspective illustration of another preferred embodiment of the running gear frame according to the invention.

FIG. 4 illustrates a schematic perspective view of another preferred embodiment of the running gear frame according to the invention, which constitutes a simple variant of the bogie frame 201 of FIG. 3. The only significant difference to the bogie frame 201 of FIG. 3 is that the respective longitudinal beam 202 is divided into two halves, provided as a forward longitudinal beam section 202.2 and as a rear longitudinal beam section 202.3, which are connected to each other in the portion of a joint 202.6, so that a five piece bogie frame 201 is created.

The forward longitudinal beam section 202.1 and the rear longitudinal beam section 202.3 are configured as identical components made of grey cast iron (GGG40.3 or GJS-400-18 LT)$_1$ which significantly simplifies their production, since only one basic shape has to be produced. However, it is appreciated that with other variants of the invention also different respective geometries for the two halves can be provided.

The joint 202.6 centrally extends through the respective longitudinal beam 202. Thus, the joint 202.6 substantially extends in one joining plane, whose surface orthogonal extends parallel to the longitudinal axis (x-axis) of the bogie frame 201. This arrangement of the joint has the advantage that the longest dimension of the respective cast component is limited, which yields shorter maximum dimensions for the molten mass thereby simplifying automated casting and improving its process reliability, respectively. However, it is appreciated that, in other variants of the invention, a different arrangement of the joint of the two halves can also be provided.

Mostly, in order to support bending moments, the longitudinal beam sections 202.1, 202.3 are connected by one or plural longitudinal bolts 206. The respective longitudinal beam section 202.1, 202.3 is furthermore connected to the transverse beam 203 by one or more connection elements 205, e.g. tension anchors, operating in the direction of the transverse axis (y-axis) of the bogie frame 201, wherein said connection elements prevent a liftoff or pull-off of the transverse beam 203 along the height axis (z-axis), or along the transverse axis (y-axis), so that a permanent connection is assured in all directions. However, it is appreciated that the connection between the transverse beam 203 and the respective longitudinal beam 202 can be established in any other suitable manner. Thus, any connection with friction locking, form locking or bonding, or any combination thereof can be selected according to the load situations to be expected at the bogie.

It is furthermore appreciated that, in other variants of the invention, the transverse beam 203 shown in the FIGS. 3 and 4 does not have to be made of grey cast iron material but can be configured e.g. in a conventional manner as a welded construction made of sheet steel material, and/or as a cast construction made of cast steel. On the other hand, the transverse beam can certainly also be made of grey cast iron material, while the longitudinal beams are entirely or partially provided as a welded construction made of steel sheet material and/or as a cast construction made of cast steel material.

Fifth Embodiment

Figure 5:
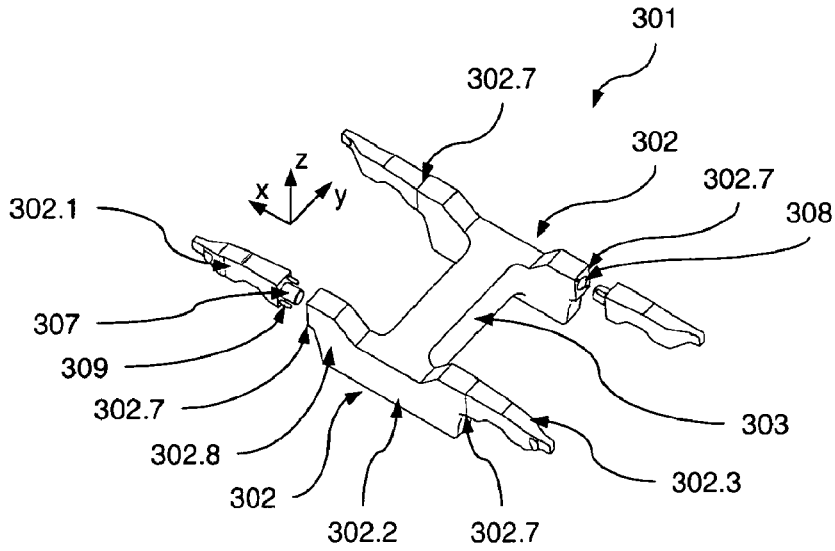
FIG. 5 shows a schematic perspective illustration of another preferred embodiment of the running gear frame according to the invention.

FIG. 5 illustrates a schematic perspective view—in partially exploded view—of another preferred embodiment of the running gear frame 301 according to the invention, which has the same outer geometry as the bogie frame 101. The bogie frame 301 thus comprises two substantially parallel lateral longitudinal beams 302 and a centrally disposed transverse beam 303 connecting them. Each longitudinal beam 302 comprises a forward longitudinal beam section 302.1, a center longitudinal beam section 302.2, and a rear longitudinal beam section 302.3.

In the region of the forward longitudinal beam section 302.1, the later bogie is supported via a primary spring suspension—not shown—on a forward wheel unit, e.g. a forward wheel set—not shown either. In the region of the rear longitudinal section 302.3, the later bogie, is supported via a primary spring suspension—not shown—on a rear wheel unit, e.g. a rear wheel set—not shown either.

The bogie frame 301 is configured in five components in the present example. The forward longitudinal beam section 302.1 and the rear longitudinal beam section 302.3 are configured as separate grey cast iron components (GGG40.3 or GJS-400-18U LT) which are mounted to the center longitudinal beam section 302.2. The transverse beam 303 is configured as an integral cast component (GGG40.3 or GJS-400-18U LT) together with the respective center longitudinal beam section 302.2. In other words, the respective center longitudinal beam section 302.2 is monolithically connected to the transverse beam 303.

However, it is appreciated that in other variants of the invention, also another, in particular disengageable, connection between the transverse beam 303 and the longitudinal beam section 302.2 can be provided. In particular, this connection can be configured in a form as it has been described in the context of FIG. 3 for a monolithic longitudinal beam.

The forward longitudinal beam section 302.1 or the rear longitudinal beam section 302.3 are respectively connected to the center longitudinal beam section 302.2 in the region of a joint 302.7. The joint 302.7 respectively extends in a joining plane, whose surface normal extends in the direction of the longitudinal axis (x-axis) of the bogie frame 301. However, it is appreciated that, in other variants of the invention, also another configuration (e.g. stepped) and alignment (e.g. inclined relative to the longitudinal axis) can be provided for the joint.

The joint 302.7 is respectively disposed on the side of a downward pointing angulation 302.8 of the longitudinal beam 302 facing away from the center of the longitudinal beam. Hereby, the joint is disposed in a portion of the longitudinal beam 302, in which, on the one hand, a component cross section is already provided which is sufficiently sized for a stable connection, and where, on the other hand, still comparatively small bending moments occur, so that the loads to be borne by the joint are still comparatively moderate. It is hereby achieved that the complexity of the joint remains within limits.

The connection between the forward longitudinal beam section 302.1 or the rear longitudinal beam section 302.3 and the center longitudinal beam section 302.2 is provided by a connection element in the form of a pin 307, which is inserted into a respective recess 308 in the center longitudinal beam section 302.2 with a press fit. However, it is appreciated that the connection can also be performed in any other suitable manner. Thus, any connection with friction locking, form locking or bonding, or any combination thereof, can be selected according to the load situations to be expected at the bogie.

The pin 307 and the associated recess 308 respectively have a substantially constant circular cross section over their length. It is appreciated, however, that in other variants of the invention, also at least in portions a stepped or conical shape can be provided. Centering pins 309 secure the longitudinal beam sections 302.1 or 302.3 against a rotation about the x-axis relative to the center longitudinal beam section 302.2.

The pin 307 and the associated recess 308 are already formed when casting the respective component. Depending on the precision achievable by the casting method employed, additional machining of the fit surfaces may not be necessary, so that particularly simple production is facilitated. However, it is appreciated that it can also be provided in other methods according to the invention that the pin 307 and the associated recess 308 are fabricated in their entirety only after casting (e.g. by turning, milling or drilling, respectively, etc.).

Furthermore, the respective longitudinal beam 302 is connected to the transverse beam 303 through one or more connection elements 305, e.g. tension anchors, which operate in the direction of the transverse axis (y-axis) of the bogie frame 301 and prevent a liftoff or pull-off of the transverse beam 303 along the height axis (z-axis) or along the transverse axis (y-axis), so that a permanent connection is assured in all directions. However, it is appreciated that the connection between the transverse beam 303 and the respective longitudinal beam 302 can be established in any other suitable manner. Thus, any connection with friction locking, form locking or bonding, or any combinations thereof can be selected according to the load situations to be expected at the bogie.

The forward longitudinal beam sections 302.1 and the rear longitudinal beam sections 302.3 are configured as identical components made of grey cast iron (GGG40.3 or GJS-400-18U LT), which significantly simplifies their production, since only a single basic shape has to be produced. The division into separate forward longitudinal beam sections 302.1 and rear longitudinal beam sections 302.3, and the transverse beam 303 with the center longitudinal beam section 302.2 facilitates automated casting or increases its process reliability, since the molten material only has to pass through short maximum flow paths.

The components interacting in the region of the joint 302.7 can be coated with a coating which prevents friction corrosion, in particular with a coating comprising molybdenum (Mo), in order to provide a higher load bearing capacity of the connection.

Sixth Through Ninth Embodiment

FIGS. 6 through 9 show schematic perspective illustrations of other preferred embodiments of the running gear frame according to the invention—partially in an exploded view—which illustrate respective simple variants of the bogie frame 301 of FIG. 5. The only substantial difference relative to the bogie frame 201 in FIG. 5 is the configuration of the respective joint of the forward longitudinal beam section 302.1 and of the rear longitudinal beam section 302.3 with the center longitudinal beam section 302.2.

Figure 6:
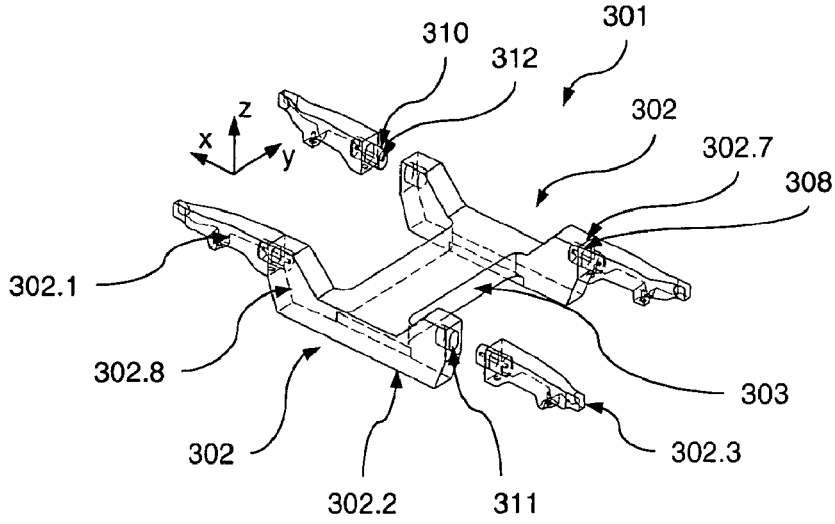
FIG. 6 shows a schematic perspective illustration of another preferred embodiment of the running gear frame according to the invention.
Figure 7:
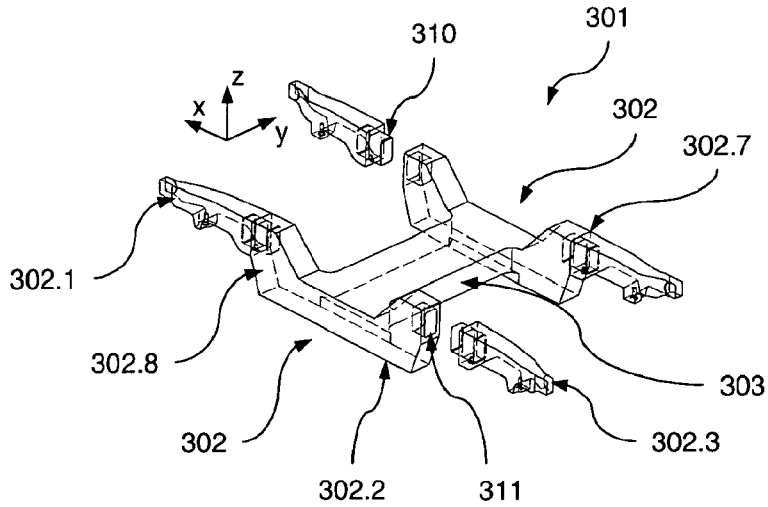
FIG. 7 shows a schematic perspective illustration of another preferred embodiment of the running gear frame according to the invention.

In the embodiments of FIGS. 6 and 7, respectively, a separate connection bolt 310 is inserted with a press fit into respective recesses 311 in the forward or rear longitudinal beam section 302.1 or 302.3, respectively, and in the center longitudinal beam section 302.2. However, it is appreciated that the connection can also be performed in any other suitable manner. Thus, any connection with friction locking, form locking or bonding, or any combinations thereof can be selected according to the load situations to be expected at the bogie.

The connection bolt 310 and the associated recesses 311 respectively comprise a cross section which is substantially constant over their length. However, it is also appreciated that, at least section wise, a stepped or conical shape can be provided in other variants of the invention. The cross section of the connection bolt 310 of FIG. 6 is substantially elliptical, while it is substantially rectangular in the embodiment of FIG. 7. The respective cross section of the connection bolt 310 thus differs from a circular shape, so that centering pins or similar, which secure the longitudinal beam sections 302.1 or 302.3 against rotation (about the x-axis) relative to the center longitudinal beam section 302.2 can be omitted.

The recesses 311 are already formed when casting the respective component. Depending on the precision which can be achieved by the automated casting method used, a further machining of their fit surfaces can be omitted, which provides a particularly simple production. However, it is appreciated that it can also be provided in other variants of the invention that the recesses 311 are only fabricated to completion after casting (e.g. by milling etc.).

A particularity of the embodiment according to FIG. 6 is provided by a central bore hole 312 of the respective connection bolt 310 in which an ultrasonic head—not shown in greater detail—of a non-destructive materials testing device is received. Through said ultrasonic head, a testing of the integrity of the joint between the longitudinal beam section 302.1 or 302.3 and the center longitudinal beam section 302.2 can be performed in conjunction with a corresponding measurement logic at constant intervals.

Figure 8:
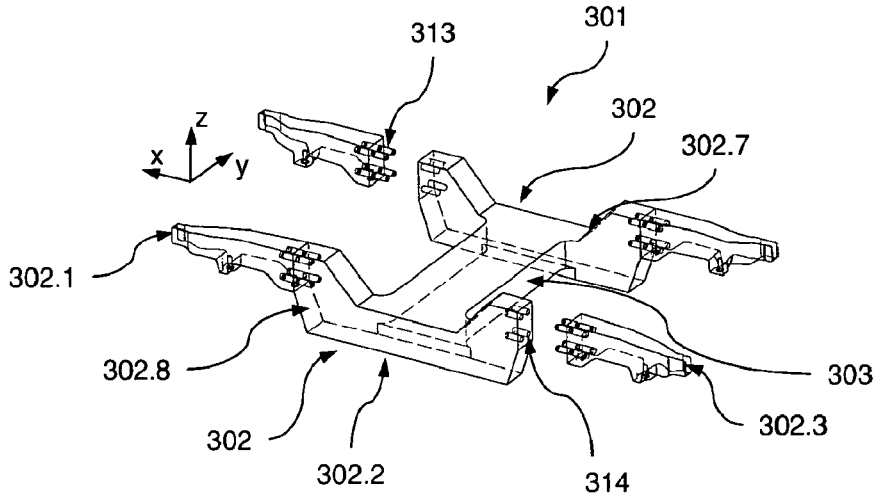
FIG. 8 shows a schematic perspective illustration of another preferred embodiment of the running gear frame according to the invention.

In the embodiment of FIG. 8, four separate cylindrical connection bolts 313 are respectively provided, which are inserted with a press fit into respective recesses 314 in the forward or rear longitudinal beam sections 302.1 or 302.3, respectively, and in the center longitudinal beam section 302.2. However, it is appreciated that the connection can also be performed in any other suitable manner. Thus, any connection with friction locking, form locking or bonding, or any combination thereof can be selected according to the load situations to be expected at the bogie frame.

Figure 9:
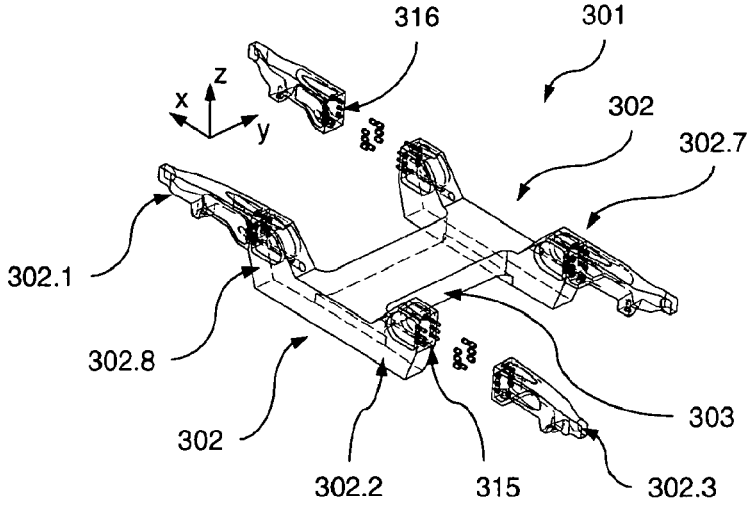
FIG. 9 shows a schematic perspective illustration of another preferred embodiment of the running gear frame according to the invention.

In the embodiment of FIG. 9, six tension anchors 315 are respectively provided, which are inserted into respective bore holes 316 in the forward or rear longitudinal beam section 302.1 or 302.3, respectively, and in the center longitudinal beam section 302.2, and by which the forward or rear longitudinal beam section 302.1 or 302.3, respectively, are clamped together with the center longitudinal beam section 302.2.

Tenth and Eleventh Embodiment

Figure 10:
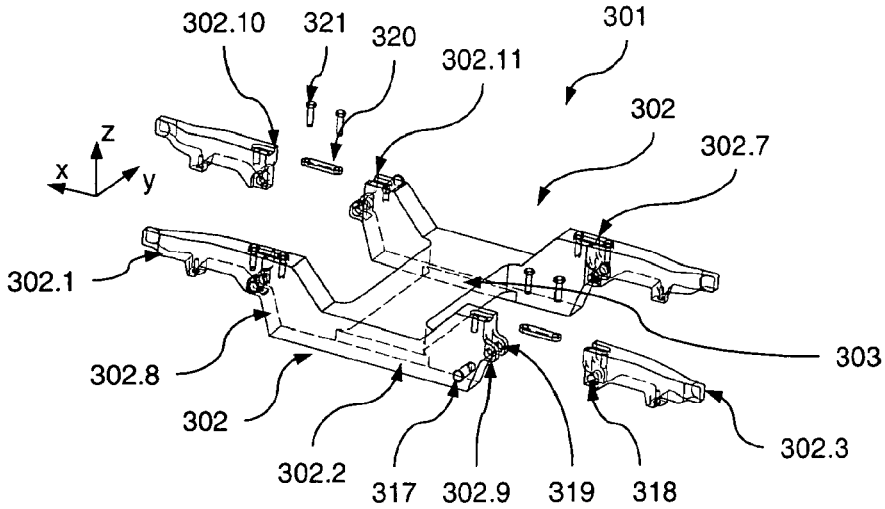
FIG. 10 shows a schematic perspective illustration of another preferred embodiment of the running gear frame according to the invention.
Figure 11:
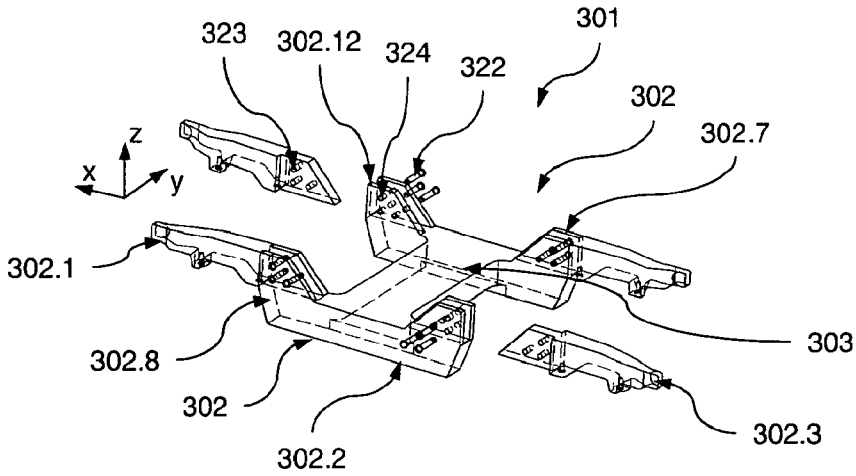
FIG. 11 shows a schematic perspective illustration of another preferred embodiment of the running gear frame according to the invention.

FIGS. 10 and 11 show schematic perspective illustrations of additional preferred embodiments of the running gear frame according to the invention in a partial exploded view, which respectively illustrate simple variants of the bogie frame 301 of FIG. 5. The only significant difference relative to the bogie frame 301 of FIG. 5 also here is the configuration of the connection of the forward longitudinal beam section 302.1 and the rear longitudinal beam section 302.3, respectively, with the center longitudinal beam section 302.2.

In the embodiment of FIG. 10, a separate connection bolt 317 is respectively provided, which is inserted with a slight press fit in transverse direction (y-direction) of the frame body 301 into respective recesses 318 in the forward or rear longitudinal beam section 302.1 or 302.3, respectively, and into recesses 319 in the center longitudinal beam section 302.2. The recesses 319 are configured in two lateral plates 302.9 of the center longitudinal beam section 302.2, which protrude in the longitudinal direction (x-direction) of the frame body 301. However, it is understood that the connection can also be performed in any suitable manner. Thus, any connection with friction locking, form locking or bonding, or any combination thereof can be selected according to the load situations to be expected at the bogie.

The connection bolt 317 is disposed in the lower section of the portion of the respective longitudinal beam 302, which is under tension stress under static load. Through its alignment in transverse direction (y-direction) of the frame body 301, it is furthermore mostly shear-stressed under a static load of the frame body.

The arrangement in the region of the frame body 301 which is shear-stressed under static load has the advantage that the support of moments in the portion disposed above, which is compression loaded under static load, can be simply performed by contact surfaces 302.10, 302.11 at the forward or rear longitudinal beam sections 302.1 or 302.3, respectively, and at the center longitudinal beam section 302.2.

Furthermore, due to the high weight of a rail vehicle, there is the advantage that, at least for a major portion of the dynamic loads to be expected during driving operation, there is always a certain compression load in the portion compression loaded under static load so that possibly a permanent preload between the forward or rear longitudinal beam sections 302.1 or 302.3, respectively, and the respective center longitudinal beam section 302.2 can be assumed as a baseline. Thus, the connection can possibly even be performed without additional connection elements. In the present example, however, a plate 320 bridging the joint 302.7 is provided as a simple liftoff safety in the portion compression loaded under static load which are mounted by bolts 321 to the forward or rear longitudinal beam sections 302.1 or 302.3, respectively, and the center longitudinal beam section 302.2, and thus prevent a pivoting of the forward or rear longitudinal beam sections 302.1 or 302.3, respectively, about the connection bolt 317 even in extreme cases.

In the embodiment of FIG. 11, three respective separate connection bolts 322 are inserted with a slight press fit in the transverse direction (y-direction) of the frame body 301 into respective recesses 323 in the forward or rear longitudinal beam sections 302.1 or 302.3, respectively, and recesses 324 in the center longitudinal beam section 302.2. The recesses 3 are thus configured in the portion of the angulation 302.8 in respective lateral ears 302.12 of the center longitudinal beam section 302.2, wherein said ears protrude in vertical direction (z-direction) of the frame body 301. However, it is understood that the connection can also be established in any other suitable manner. Thus, any connection with friction locking, form locking or bonding, or any combinations thereof can be selected according to the load situations to be expected at the bogie.

Through their alignment in the transverse direction (y-direction) of the frame body 301, also the connection bolts 322 are in turn mostly shear-stressed under static load of the frame body 301.

The primarily occurring shear-loading of the connection bolt 317 (FIG. 10) or of the connection bolt 322 (FIG. 11) ultimately yields the advantage that the connection bolt 317 or 322 is mostly loaded in a direction transverse to its joining or assembly direction. The strength of the connection between the forward or rear longitudinal beam sections 302.1 or 302.3, respectively, and the center longitudinal beam section 302.2 thus becomes at least mostly independent of the quality of the joining process of the connection bolt 317 or 322, but now only depends on the properties (e.g. shear strength, etc.) of the connection bolt 317 or 322. Under certain conditions, a simple position safety of the connection bolt 317 (e.g. through retaining rings, etc.) suffices in order to assure a permanent and reliable connection of the forward or rear longitudinal beam sections 302.1 or 302.3, respectively, with the center longitudinal beam section 302.2.

The lateral ears 302.9 (FIG. 10) or 302.12 (FIG. 11) and the recesses 318, 319 (FIG. 10) or 323, 324 (FIG. 11) are already formed when casting the respective component. Depending on the precision which can be achieved by the automated casting method used, possibly, even an additional machining of its fit surfaces can be omitted, so that a particularly simple production is accomplished. However, it is appreciated that it can also be provided, in other variants of the invention, that the lateral ears 302.9 (FIG. 10) or 302.12 (FIG. 11) and recesses 318, 319 (FIG. 10) or 323, 324 (FIG. 11) can be fabricated to completion only after casting (e.g. by milling, drilling, etc.).

Twelfth Embodiment

Figure 12:
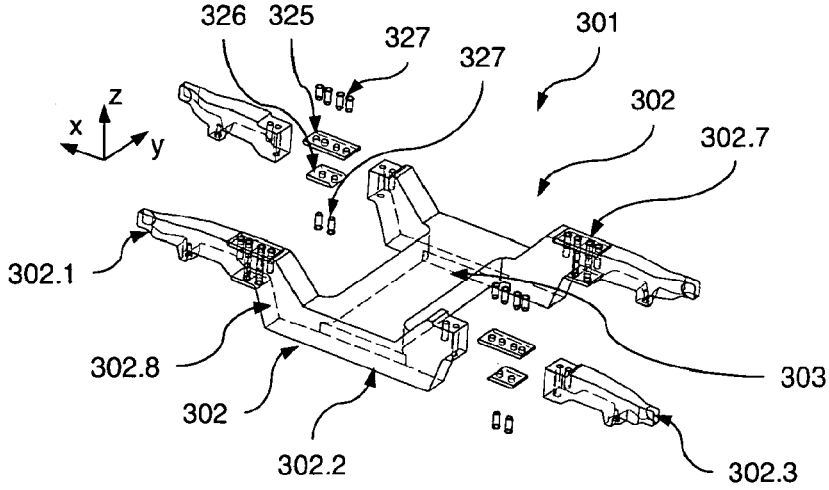
FIG. 12 shows a schematic perspective illustration of another preferred embodiment of the running gear frame according to the invention.

FIG. 12 illustrates—partially in an exploded view—a schematic perspective view of another preferred embodiment of the running gear frame according to the invention which also illustrates a simple variant of the bogie frame 301 of FIG. 5. The only significant difference to the bogie frame 301 of FIG. 5 here also lies within the configuration of the connection of the forward longitudinal beam section 302.1 and the rear longitudinal beam section 302.3, respectively, with the center longitudinal beam section 302.2.

In the embodiment of FIG. 12, respective separate plates 325 and 326 are provided on the upper side and the lower side of the longitudinal beam 302, which bridge the joint 302.7 and which are mounted to the forward or rear longitudinal beam sections 302.1 or 302.3, respectively and to the center longitudinal beam section 302.2 by means of a plurality of bolts 327. However, it is appreciated that the connection can also be performed in any other suitable manner. Thus, any connection with friction locking, form locking or bonding, or any combinations thereof can be selected according to the load situations to be expected at the bogie.

Thirteenth Embodiment

Figure 13:
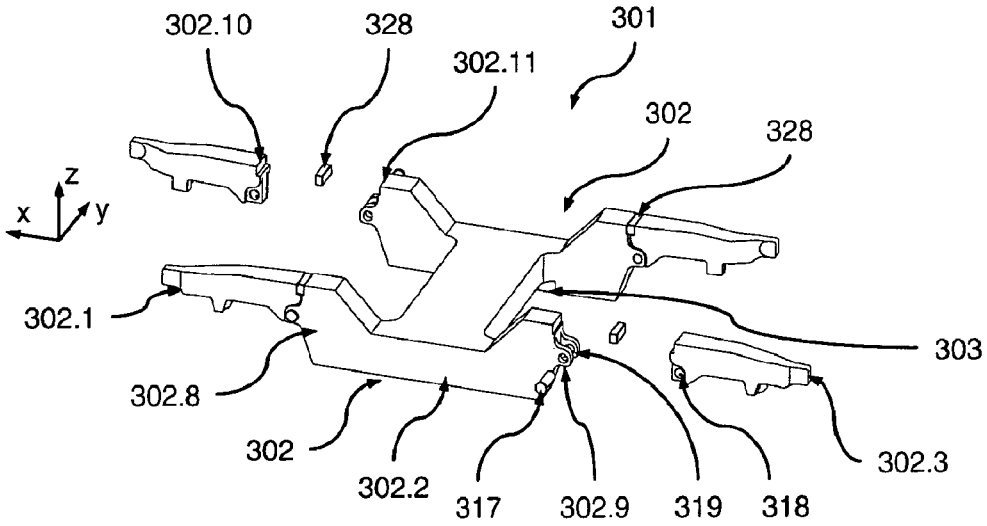
FIG. 13 shows a schematic perspective illustration of another preferred embodiment of the running gear frame according to the invention.

FIG. 13—partially in an exploded view—shows a schematic perspective illustration of another preferred embodiment of the running gear frame according to the invention which constitutes a variant of the bogie frame 301 of FIG. 10. The significant difference to the bogie frame 301 of FIG. 10 lies within the configuration of the connection of the forward longitudinal beam section 302.1 and of the rear longitudinal beam section 302.3, respectively, with the center longitudinal beam section 302.2.

In the embodiment of FIG. 13, again, a separate connection bolt 317 is provided which is inserted with a slight press fit in the transverse direction (y-direction) of the frame body 301 into respective recesses 318 in the forward or rear longitudinal beam sections 302.1 or 302.3, respectively, and into recesses 319 in the center longitudinal beam section 302.2. The recesses 319 are configured respectively in two lateral ears 302.9 of the center longitudinal beam section 302.2, which protrude in the longitudinal direction (x-direction) of the frame body 301. However, it is appreciated that the connection can also be performed in any other suitable manner. Thus, any connection with friction locking, form locking or bonding, or any combination thereof can be selected according to the load situations to be expected at the bogie.

The connection bolt 317 again is disposed in the lower portion of the respective longitudinal beam 302, which is tension stressed under static load. Due to its alignment in the transverse direction (y-direction) of the frame body 301, it is thus mostly shear-stressed under static load of the frame body.

The disposition in the section of the frame body tension stressed under static load yields the advantage that the support of moments in the portion located above it, which is compression loaded under static load, can be performed in a simple manner through contact surfaces 302.10, 302.11 at the forward or rear longitudinal beam sections 302.1 or 302.3, respectively, and the center longitudinal beam section 302.2.

Furthermore, due to the high weight of a rail vehicle, this yields the advantage that, typically at least for a major portion of the dynamic loads to be expected in driving operation, a certain compression load always exists in the portion which is compression loaded under static load so that possibly a permanent preloading between the forward or rear longitudinal beam sections 302.1 or 302.3, respectively, and the respective center longitudinal beam section 302.2 is to be anticipated. Thus, the connection can possibly even be performed without additional connection elements.

The essential difference relative to the embodiment of FIG. 10 is characterized in that, at the joint between the forward or rear longitudinal beam sections 302.1 or 302.3, respectively, and at the respective center longitudinal beam section 302.2, respective elastic compression elements 328 are disposed in the upper section of the frame body 301 compression stressed under static load. Said compression element 328 is thus disposed between the abutting surfaces 302.10, 302.11 at the forward or rear longitudinal beam sections 302.1 or 302.3, respectively, and the center longitudinal beam section 302.2.

The compression element 328 thus has the advantage that it can compensate fabrication tolerances between the joining partners, in particular, in the portion of the contact surfaces 302.10 and 302.11 and of the recesses 319, in a simple manner, so that the complexity of producing the bogie frame 301 is significantly reduced.

It is furthermore possible to configure the compression element 328, so that it has sufficient spring elastic properties in order to form the primary spring suspension of the running gear comprising the bogie frame 301. It is thus appreciated that a respective relative movement between the forward or rear longitudinal beam sections 302.1 or 302.3, respectively, and the center longitudinal beam section 302.2 has to be possible in this case during operation of the bogie frame 301.

In the present embodiment, a liftoff safety similar to the plate 320 of FIG. 10 is lacking. However, it is appreciated that a respective liftoff safety can be provided in other variants of the invention. Said liftoff safety can possibly also be provided by a suitable connection between the pressure element and the respective longitudinal beam section.

It is furthermore appreciated that, in other variants of the invention, the transverse beam 303 shown in the FIGS. 5 through 13 can also not be made of a grey cast iron material, but e.g. in a conventional manner as a welded construction made from steel sheet material and/or as a cast construction made from cast steel. Similarly, conversely, the transverse beam can certainly also be made of grey cast iron material while the forward and rear longitudinal beam sections, respectively, are entirely or partially configured as welded construction from steel sheet material and/or as cast construction from cast steel material.

The present invention was described above exclusively with reference to embodiments for bogies with dual axles. However, it is appreciated that the invention can also be used in conjunction with arbitrary other running gears of different number of axles.

The invention claimed is:

1. A running gear frame for a running gear of a rail vehicle with a frame body configured to be supported on at least one wheel unit of the running gear, the frame body comprising two longitudinal beams extending in a longitudinal direction of the running gear and at least one transverse beam extending in a transverse direction of the running gear and substantially rigidly connecting the two longitudinal beams to each other, wherein the frame body is at least partially made of a grey cast iron material, wherein the frame body comprises at least two frame components which are connected to each other in the region of at least one joint, wherein at least one connection element is provided in the region of a joint, the connection element being connected to the two frame components, and wherein a portion of the joint extends substantially in one joining plane and the connection element forms at least one protrusion which extends in the direction of the surface normal of the joining plane into a respective recess in one of the two frame components.

2. The running gear frame of claim 1, wherein the frame body is at least partially made of a globular grey cast iron material.

3. The running gear frame of claim 1, wherein the connection element is at least on of monolithically configured with one of the two frame components; and connected with at least one of the two frame components through at least one connection selected from a connection group consisting of a friction locked connection and a form locked connection and a bonded connection.

4. The running gear frame of claim 1, wherein the connection element has a cross section selected from a cross section group consisting of a cross section which tapers with increasing distance from the joining plane;

a circular cross section, an elliptical cross section, and a polygonal cross section.

5. The running gear frame of claim 1, wherein the connection element is at least one of disposed in a portion of a section of the frame body which is tension stressed under static load; and disposed so that it is shear-stressed through the static load of the frame body.

6. The running gear frame of claim 1, wherein at least one connection element is an element bridging the joint and connected with both joining partners, the bridging element being one of configured as a tension anchor operating in the direction of the surface normal of the joining plane; and configured as a plate bridging the joint.

7. The running gear frame of claim 1, wherein the connection element comprises at least one recess defined therein, the recess being configured to receive a component of a non-destructive material testing device.

8. The running gear frame of claim 1, wherein at least one of the frame components in the region of the joint is at least partially provided with a coating which prevents friction corrosion.

9. The running gear frame of claim 8, wherein the coating comprises molybdenum.

10. The running gear frame of claim 1, wherein the frame body comprises a forward section, a center section and a rear section, wherein the center section connects the forward section and the rear section;

the forward section is configured to be supported on a leading wheel unit of the running gear; and the rear section is configured to be supported on a trailing wheel unit of the running gear.

11. The running gear frame of claim 10, wherein the frame body comprises at least two frame components which are connected to each other in the region of at least one joint, wherein at least one of at least one joint is disposed in the region of the center section and at least one joint is disposed in the region of the forward section; and at least one joint is disposed in the region of the rear section.

12. The running gear frame of claim 1, wherein the frame body is configured as a substantially H-shaped frame, the frame comprising two longitudinal beams extending in a longitudinal direction of the running gear and at least one transverse beam extending in a transverse direction of the running gear, the traverse beam connecting the two longitudinal beams to each other.

13. The running gear frame of claim 12, wherein at least one of the longitudinal beams comprises at least one longitudinal beam section which is connected in the region of at least one joint to one of the at least one transverse beam and another longitudinal beam section of the longitudinal beam.

14. The running gear frame of claim 13, wherein the longitudinal beam is configured in one piece and connected in the region of the joint to the at least one transverse beam.

15. The running gear frame of claim 14, wherein a portion of the joint extends substantially in a joining plane, the surface normal of the joining plane comprising at least a component in the direction of the height axis of the running gear.

16. The running gear frame of claim 13, wherein the longitudinal beam comprises two longitudinal beam sections which are connected in the region of the one respective joint with the at least one transverse beam.

17. The running gear frame of claim 16, wherein at least one of the joints includes a portion that extends substantially in a joining plane, the surface normal of the joining plane having at least one of a component in the direction of the height axis of the running gear, and a component in the direction of the transverse axis of the running gear.

18. The running gear frame of claim 13, wherein at least one of the longitudinal beams comprises a forward longitudinal beam section, a center longitudinal beam section, and a rear longitudinal beam section, wherein the center longitudinal beam section is connected to the at least one transverse beam.

19. The running gear frame of claim 18, wherein at least one of the forward longitudinal beam section and the rear longitudinal beam section is connected to the center longitudinal beam section in the region of a joint.

20. The running gear frame of claim 19, wherein at least one of the joints includes a portion that extends substantially in a joining plane, the surface normal of the joining plane having at least one of a component in the direction of the longitudinal axis of the running gear, and a component in the direction of the transverse axis of the running gear, and a component in the direction of the height axis of the running gear.

21. The running gear frame of claim 20, wherein the surface normal of the joining plane is at least one of substantially parallel to the longitudinal axis of the running gear; and substantially parallel to the transverse axis of the running gear; and substantially parallel to the height axis of the running gear.

22. The running gear frame of claim 18, wherein a compression element is disposed in the region of at least one of the joints between the center longitudinal beam section and one of the forward longitudinal beam section and the rear longitudinal beam section.

23. The running gear frame of claim 18, wherein at least one of the longitudinal beams comprises a respective downward angulation between the ends and the center of the longitudinal beam; and at least one of the joints is disposed in the region of the angulation or is disposed on the side of the angulation facing away from the center of the longitudinal beam.

24. The running gear frame of claim 18, wherein the center longitudinal beam section is monolithically formed with the at least one transverse beam.

25. The running gear frame of claim 12, wherein at least a portion of at least one of the longitudinal beams is made of grey cast iron material.

26. A running gear for a rail vehicle with a running gear frame according to claim 1.

27. The running gear of claim 26, the running gear being configured as a bogie.

28. The running gear frame of claim 1, wherein the at least two frame components are disengagably connected to each other.

29. The running gear frame of claim 1, wherein the frame body is at least partially made of one of GGG40.3 and GJS-400-18U LT.

30. A method for producing a running gear frame for a running gear of a rail vehicle, comprising the steps of:

providing a frame body of the running gear frame, the frame body being configured to be supported at least on one wheel unit of the running gear, the frame body comprising two longitudinal beams extending in a longitudinal direction of the running gear and at least one transverse beam extending in a transverse direction of the running gear and substantially rigidly connecting the two longitudinal beams to each other, wherein the frame body is at least partially made of a grey cast iron material, and wherein the frame body comprises at least two frame components;

connecting the frame components to each other in the region of at least one joint;

providing at least one connection element in the region of a joint, the connection element being connected to the two frame components, wherein a portion of the joint extends substantially in one joining plane and the connection element forms at least one protrusion which extends in the direction of the surface normal of the joining plane into a respective recess in one of the two frame components.

31. The method of claim 30, wherein the frame body is cast in a single step.

32. The method of claim 30, wherein the frame body comprises at least two frame components;

the at least two frame components are cast from a grey cast iron material as separate components; and the at least two frame components are connected.

33. The method of claim 30, wherein the frame body comprises at least two frame components;

at least one of the at least two frame components is cast from a grey cast iron material;

at least one of the at least two frame components is made from steel; and the at least two frame components are connected.

* * * * *